US010325747B2

(12) United States Patent
McWhinney et al.

(10) Patent No.: US 10,325,747 B2
(45) Date of Patent: Jun. 18, 2019

(54) IN-LINE HIGH CURRENT FUSE HOLDER ASSEMBLY

(71) Applicant: Littelfuse, Inc., Chicago, IL (US)

(72) Inventors: Matthew McWhinney, Chicago, IL (US); Geoffrey Schwartz, Stoughton, MA (US)

(73) Assignee: LITTELFUSE, INC., Chicago, IL (US)

( * ) Notice: Subject to any disclaimer, the term of this patent is extended or adjusted under 35 U.S.C. 154(b) by 4 days.

(21) Appl. No.: 15/420,302

(22) Filed: Jan. 31, 2017

(65) Prior Publication Data

US 2018/0218870 A1 Aug. 2, 2018

(51) Int. Cl.
*H01H 85/20* (2006.01)
*H01H 85/143* (2006.01)
*H01H 85/153* (2006.01)

(52) U.S. Cl.
CPC ..... *H01H 85/204* (2013.01); *H01H 85/201* (2013.01); *H01H 85/143* (2013.01); *H01H 85/153* (2013.01); *H01H 85/203* (2013.01)

(58) Field of Classification Search
CPC .. H01H 85/203; H01H 85/055; H01H 85/143; H01H 85/165; H01H 85/52; H01R 4/22; H01R 4/70
USPC ..... 337/187
See application file for complete search history.

(56) References Cited

U.S. PATENT DOCUMENTS 3,599,174 A * 8/1971 Dhaliwal ..... H01H 85/20 337/209
3,778,741 A * 12/1973 Schmidt, Jr. ..... H01H 85/201 337/201
4,333,701 A * 6/1982 Schick ..... H01H 85/201 439/410
5,018,991 A * 5/1991 Katz ..... H01H 85/542 337/205
5,631,619 A * 5/1997 Evans ..... B22D 19/00 337/166
5,859,580 A * 1/1999 Hashizawa ..... H01H 85/56 337/255
6,030,257 A * 2/2000 Furuya ..... H01H 85/2045 439/620.26
2009/0309689 A1* 12/2009 Pavlovic ..... H01H 85/153 337/187

* cited by examiner

*Primary Examiner* — Jacob R Crum

(57) ABSTRACT

Provided herein are approaches for securing an electrical protection device (e.g., a fuse). In one approach, an apparatus includes a conductor and a terminal coupling the conductor to the fuse, wherein the terminal includes an end cap having a cavity for receiving and securing the conductor, and a set of contact elements extending from a base member. The base member may be coupled to the end cap, and a body of the fuse may be coupled to the base member. In some approaches, a fuse blade of the fuse is disposed between the set of contact elements. In some approaches, the apparatus further includes a cover adjacent the terminal, wherein the cover is configured to engage the contact elements to increase a contact force and electrical connection between the set of contact elements and the fuse blade.

19 Claims, 9 Drawing Sheets

IN-LINE HIGH CURRENT FUSE HOLDER ASSEMBLY

FIELD OF THE DISCLOSURE

The disclosure relates generally to electrical protection devices, and more particularly, to an apparatus for securing electrical protection devices.

BACKGROUND OF THE DISCLOSURE

Electrical protection devices such as fuses have long been used in electrical devices for providing an interruptible electrical connection between a source of electrical power and a component in an electrical circuit that is to be protected. For example, upon the occurrence of an overcurrent condition in a circuit, such as may result from a short circuit or other sudden electrical surge, an element within the fuse may separate and interrupt the flow of electrical current to a protected circuit component, thereby preventing or mitigating damage to the component that would otherwise result if the overcurrent condition were allowed to persist.

A variety of different types of fuse holders are known to provide electrical interfaces for overcurrent protection fuses. One type of fuse holder is an inline fuse holder that electrically connects a ferrule fuse within an electrical system. Among several applications, the inline fuse holder may be used in solar photovoltaic systems. The inline fuse holder assembly typically comprises a holder body having two pieces that releasably attach to one another using a compression nut and define an interior space for receiving the fuse.

Typically, at least two contacts of the inline fuse electrically connect to the terminals of the fuse when the fuse is received in the fuse holder body. The contacts include wire connectors that extend outside the holder body. The wire connectors are connectable to (e.g., crimped onto) wires that are electrically connected to the electrical system.

SUMMARY

In view of the foregoing, what is needed is an inline high current fuse holder assembly for securing an electrical protection device (e.g., a fuse) therein. In one approach, an apparatus includes a conductor and a terminal coupling the conductor to the electrical protection device. The terminal may include an end cap having a cavity for receiving and securing the conductor, a set of contact elements extending from a base member, wherein the base member is coupled to the end cap, and wherein a body of the electrical protection device coupled to the base member.

In another approach, a fuse assembly includes a conductor and a plurality of terminals coupling the conductor to a fuse. Each of the plurality of terminals may include an end cap having a cavity for receiving and securing the conductor, and a set of contact elements extending from a base member, wherein the base member is coupled to the end cap. The fuse assembly may further include a cover adjacent the plurality of terminals, wherein the cover engages the set of contact elements in a closed position.

In yet another approach, a method of securing a fuse element includes providing a terminal coupling a conductor to a fuse, the terminal including an end cap having a cavity for receiving and securing the conductor, and a set of contact elements extending from a base member. The base member may be coupled to the end cap, and the base member may be coupled to a fuse body of the fuse. The method may further include providing a cover adjacent the terminal, wherein the cover engages the set of contact elements in a closed configuration.

BRIEF DESCRIPTION OF THE DRAWINGS

The accompanying drawings illustrate exemplary approaches of the disclosed embodiments so far devised for the practical application of the principles thereof, and in which:

FIG. 8 is an end cross-sectional view of the fuse assembly and cover of

FIG. 7 according to an exemplary approach of the disclosure.

FIG. 11 is an end cross-sectional view of the fuse assembly and cover of

FIG. 7 according to an exemplary approach of the disclosure.

Figure 1:
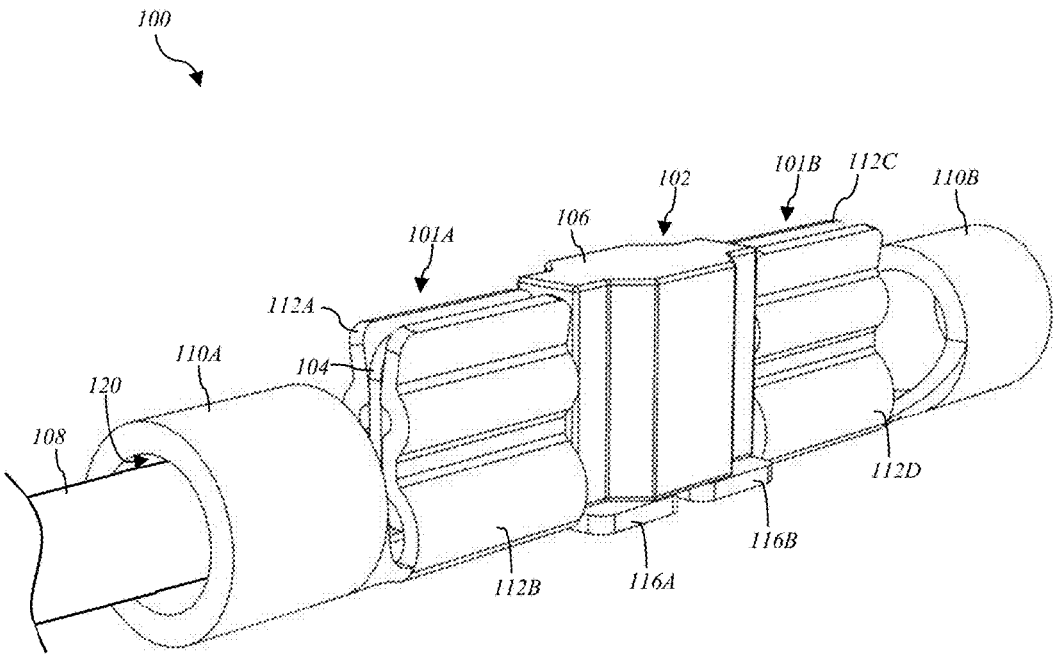
FIG. 1 is an isometric view of a fuse assembly according to an exemplary approach of the disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The system/circuit may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of various components and their constituent parts. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

As stated above, described herein are approaches for securing an electrical protection device, such as midi and mega fuses, or a transient-voltage-suppression (TVS) diode. In one approach, an apparatus includes a conductor and a terminal coupling the conductor to the electrical protection device, wherein the terminal includes: an end cap having a cavity for receiving and securing the conductor; a set of (i.e., one or more) contact elements extending from a base member, the base member coupled to the end cap; and a body coupled to the base member, the body containing the electrical protection device. In some approaches, the electrical protection device is a fuse element having a fuse blade and fuse body, wherein the fuse blade is disposed between the set of contact elements. In some approaches, the apparatus further includes a cover adjacent the terminal, wherein the cover is configured to engage the contact elements to increase a contact force and electrical connection between the set of contact elements and the fuse blade.

Figure 2:
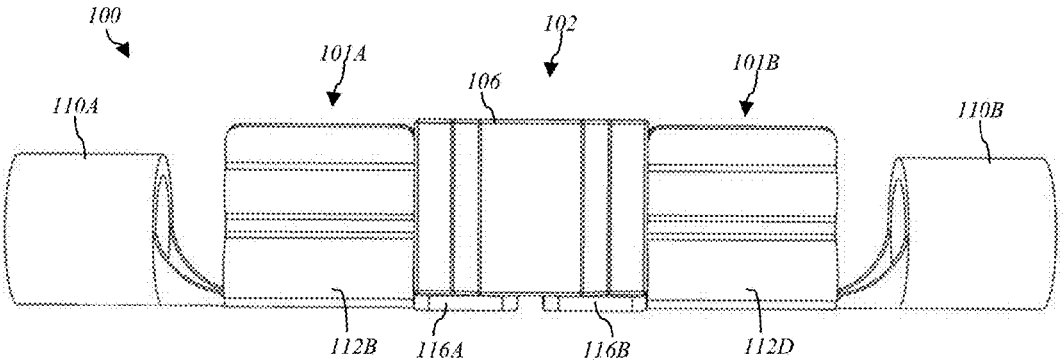
FIG. 2 is side view of the fuse assembly of FIG. 1 according to an exemplary approach of the disclosure.
Figure 3:
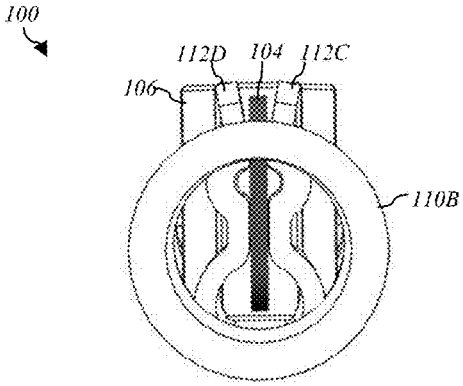
FIG. 3 is a side view of the fuse assembly of FIG. 1 according to an exemplary approach of the disclosure.

FIGS. 1-3 illustrate an exemplary embodiment of an inline fuse assembly 100 in accordance with the present disclosure. As shown, the fuse assembly 100 may include one or more terminals 101A-B coupled to an electrical protection device 102 (e.g., a fuse) having a fuse blade 104 and a fuse body 106. The fuse assembly 100 may further include a conductor 108, such as one or more wires, and a pair of electrically conductive end caps 110A-B that electrically couple the conductor 108 to the fuse 102. The conductor 108 may provide an electrical connection between the fuse 102 and various other circuit elements (not shown) for which the fuse 102 may provide protection against certain overcurrent conditions.

As shown, the terminals 101A-B are disposed on opposite sides of the fuse 102, and couple the conductor 108 to the fuse 102. As further shown, the terminals 101A-B include respective end caps 110A-B, a set of contact elements 112A-D coupled to and disposed on opposite sides of the fuse blade 104, and a set of base members 116A-B supporting the set of contact elements 112A-D and the fuse body 106.

The fuse blade 104 extends through the fuse body 106, which may be formed of any suitable, electrically insulating material, including, but not limited to, glass, ceramic, plastic, and the like. The end caps 110A-B may be formed of any suitable, electrically conductive material, including, but not limited to, copper, aluminum, brass, gold, silver, or other metallic conductors. The fuse blade 104 may be formed of any suitable electrically conductive material, including, but not limited to, copper, tin, nickel, and the like, and may be formed as a ribbon, wire, metal link, spiral wound wire, film, electrically conductive core deposited on a substrate, or any other suitable structure that is configured to separate or otherwise break the electrical connection between the end caps 110A-B upon the occurrence of an overcurrent condition. As will be appreciated, the particular size, volume, configuration, and conductive material of the fuse blade 104 may all contribute to the rating of the fuse 102.

As demonstrated in FIG. 1, the stripped end of the conductor 108 may be longitudinally inserted into a cavity 120 formed in the end cap 110A. Although not shown, a similar conductor may be inserted into a cavity formed in opposite end cap 110B. Once the conductor 108 has been inserted thusly, the end cap 110A, which may be formed of a malleable material, may be crimped, crushed, bent, flattened, or otherwise deformed (hereinafter collectively referred to as "crimped") so as to pinch and securely trap the end of the conductor 108 therein. Depending on its rigidity, the end cap 110A may be crimped using a manual tool (e.g. pliers), by hand (e.g. manually pinched between fingers), or by various automated means. The conductor 108 may thereby be held in firm engagement with the terminal 101A, and a secure electrical connection may be established therebetween without requiring additional fasters, adhesives, or the application of solder.

Figure 4:
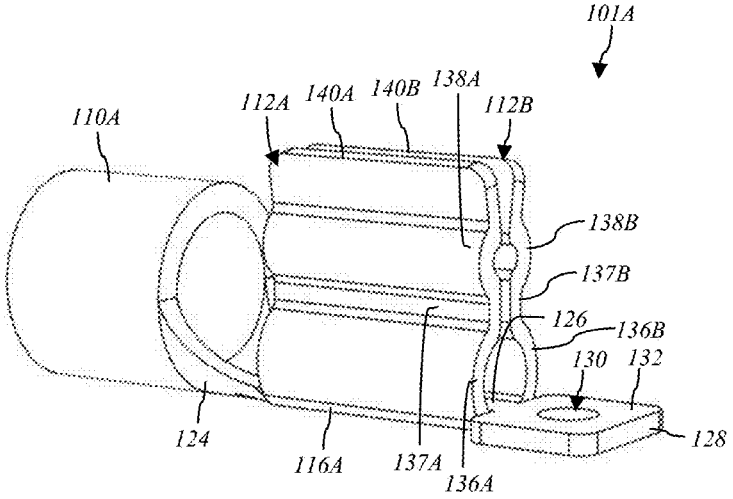
FIG. 4 is an isometric view of a terminal of the fuse assembly of FIG. 1 according to an exemplary approach of the disclosure.
Figure 5:
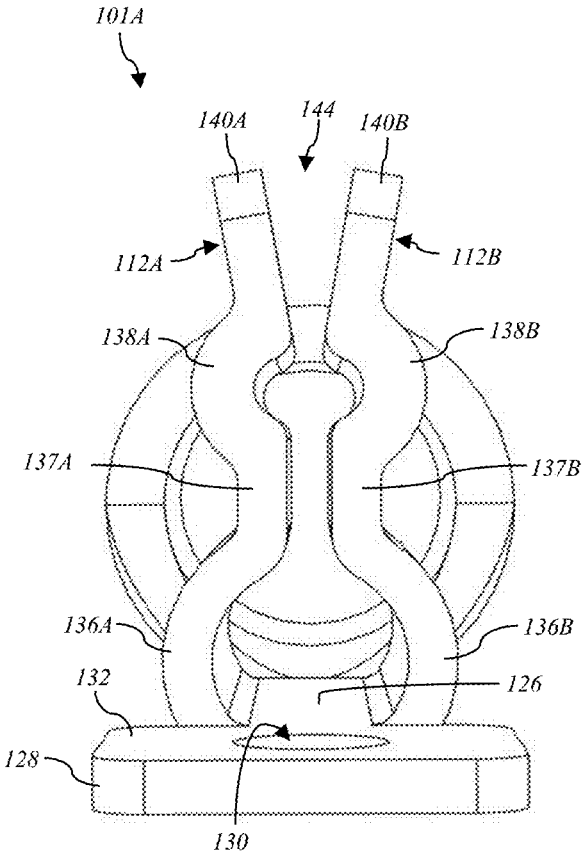
FIG. 5 is a side view of the terminal of FIG. 4 according to an exemplary approach of the disclosure.

Referring now to FIGS. 4-5, one terminal of the fuse assembly 100 will be described in greater detail. As shown, the terminal 101A includes the end cap 110A integrally coupled to the base member 116A, and first and second contact members 112A-B extending from the base member 116A. In some embodiments, the base member 116A includes a reinforcement member 124 extending between the end cap 110A and the first and second contact members 112A-B. The base member 116A further includes a first section 126 extending between the first and second contact members 112A-B, and a second section 128 configured as a tab with an opening 130 formed therein. The second section 128 receives the fuse body 106 along a top surface 132 thereof, and the opening 130 may receive one or more mechanical fastening elements (not shown) of the fuse body 106 to secure the fuse body 106 adjacent to the first and second contact elements 112A-B.

As further shown, the first and second contact elements 112A-B respectively include first bowed sections 136A-B, straight sections 137A-B coupled to the first bowed sections 136A-B, second bowed sections 138A-B, and free ends 140A-B. In some embodiments, the free ends 140A-B are angled away from one another and define an opening 144 therebetween configured to receive the fuse blade 104. The first and second contact elements 112A-B extend from the first section 126, and may be integrally formed with the base member 116A.

Figure 6:
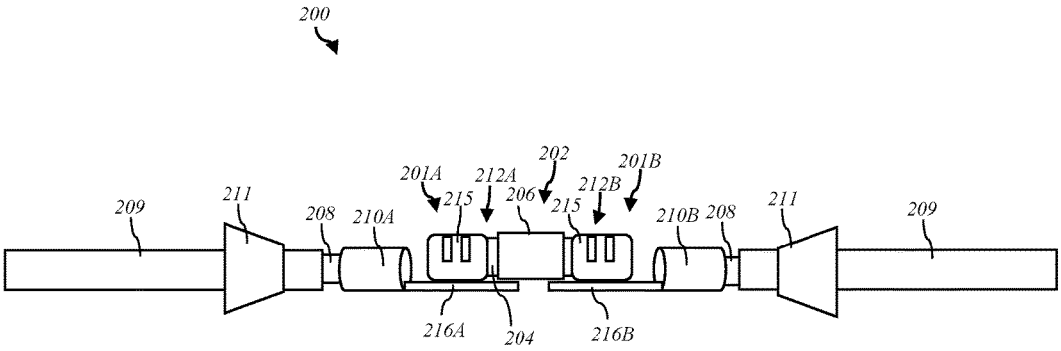
FIG. 6 is side view of a fuse assembly according to an exemplary approach of the disclosure.

Turning now to FIG. 6, another exemplary embodiment of an inline fuse assembly 200 in accordance with the present disclosure will be described in greater detail. The fuse assembly 200 may share similar features to that of the fuse assembly 100 depicted in FIGS. 1-5. As shown, the fuse assembly 200 may include one or more terminals 201A-B coupled to an electrical protection device 202 (e.g., a fuse). The fuse assembly 200 may further include a conductor 208, such as one or more wires, and a pair of electrically conductive end caps 210A-B that electrically couple the conductor 208 to the fuse 202. The conductor 208 may provide an electrical connection between the fuse 202 and various other circuit elements (not shown) for which the fuse 202 may provide protection against certain overcurrent conditions.

The terminals 201A-B are disposed on opposite sides of the fuse 202, and couple the conductor 208 to the fuse 202. As shown, the terminals 201A-B include respective end caps 210A-B, a set of contact elements 212A-B coupled to and disposed on opposite sides of the fuse blade 204, and a set of base members 216A-B supporting the set of contact elements 212A-D and the fuse body 206.

The conductor 208 may include an insulating jacket 209 and grommets 211 in some embodiments. Alternatively, it is contemplated that the insulating jacket 209 may be omitted and that the conductor 208 may include only one or more bare conductor(s). The conductor 208 may be formed of any suitable, electrically conductive material, including, but not limited to, copper, aluminum, brass, gold, silver, or other metallic conductors. The insulating jacket(s) 209 may be formed of any suitable, insulating material, including, but not limited to, polyethylene, polyvinyl chloride (PVC), polypropylene, TEFLON, and the like.

In this embodiment, the set of contact elements 212A-B each include a plurality of finger-like contact strips 215 extending upwards from the base members 216A-B, the contact strips 215 being provided to increase the number of contact points between the terminals 201A-B and the fuse blade 204. During assembly, the fuse blade 204 of the fuse 202 may be inserted between complementary and opposing fingers 215 of each contact element 212A-B.

Figure 7:
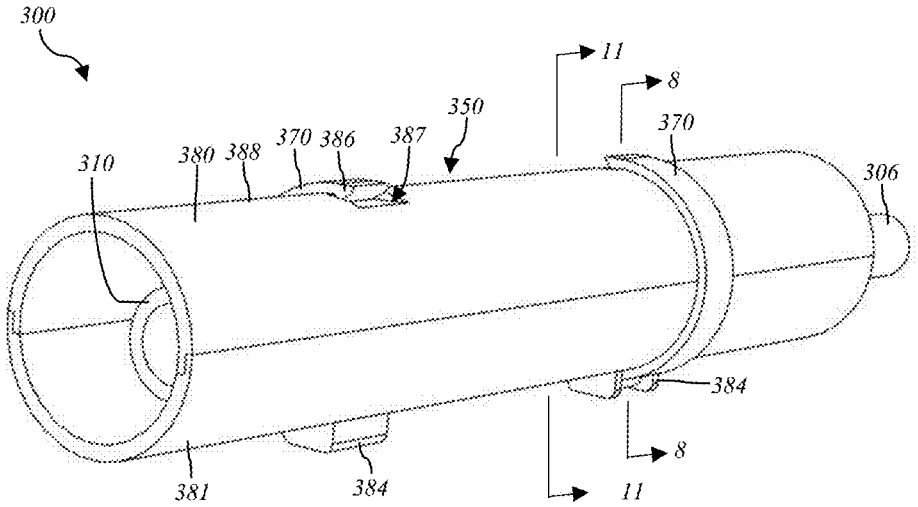
FIG. 7 is a perspective view of a fuse assembly with a cover according to an exemplary approach of the disclosure.
Figure 8:
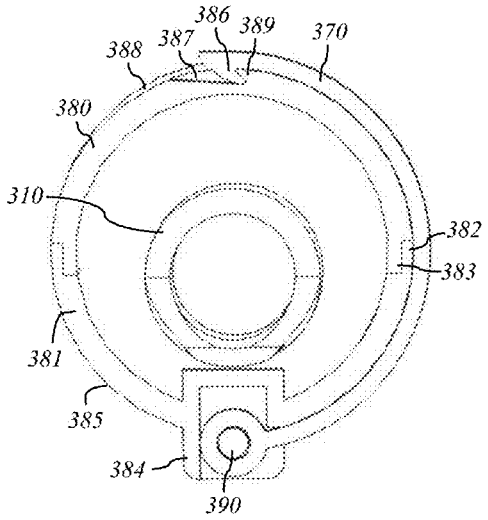

Turning now to FIGS. 7-8, an over-molding or cover 350 for use with a fuse assembly 300 according to exemplary embodiments will be described in greater detail. As shown, the cover 350 may be disposed over a protection device, such as fuse 102 and terminals 101A-B shown in FIG. 1. The assembly 300 may further include a conductor (not shown) and one or more electrically conductive end caps 310 that electrically couple the conductor to the fuse. As shown, the cover 350 may include a first section 380 matingly engaged with a second section 381, for example, by a set of overlapping tabs 382 and 383. In some embodiments, the first and second sections 380, 381 are substantially equal halves of a hollow cylinder configured to house the protection device therein. The cover 350 may be injection molded, and may be made from plastic, rubber, or other durable, wear-resistant materials.

In some embodiments, one or more releasable fasteners 370 (e.g., a latch, clasp, hook tab and openings, etc.) may be used to further secure the first and second sections 380, 381 of the cover 350 in place. In the embodiment shown, each fastener 370 is a latch pivotably coupled at a first end to a pin 390, which is secured between walls of a fastener housing 384 extending from an exterior surface 385 of the second section 381. Each fastener 370 further includes a hook tab 386 disposed at a second end thereof for engagement within a recess 387 formed in an exterior surface 388 of the first section 380 of the cover 350. As shown, each recess 387 may further define a recess hook tab 389 matingly engaged with the hook tab 386 of the fastener 370. Each fastener 370 may be flexible or rigid, and once engaged about the first and second sections 380, 381, effectively "locks" the fuse assembly 300 into a closed configuration/position.

Figure 9:
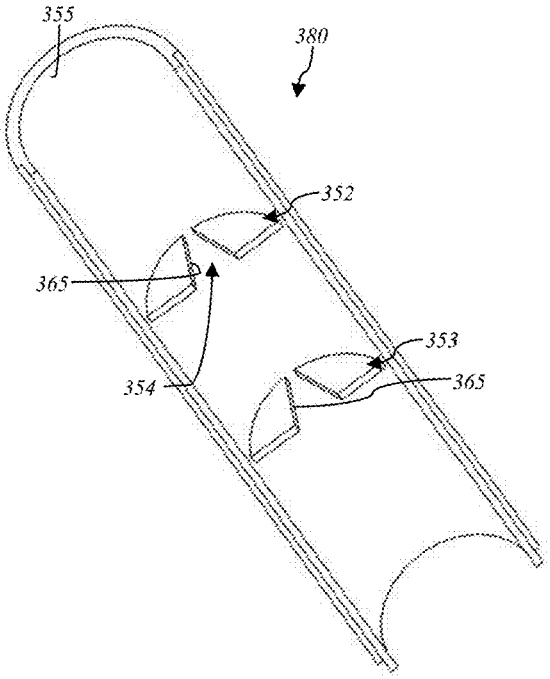
FIG. 9 is a perspective view of a first portion of the cover of FIG. 7 according to an exemplary approach of the disclosure.
Figure 10:
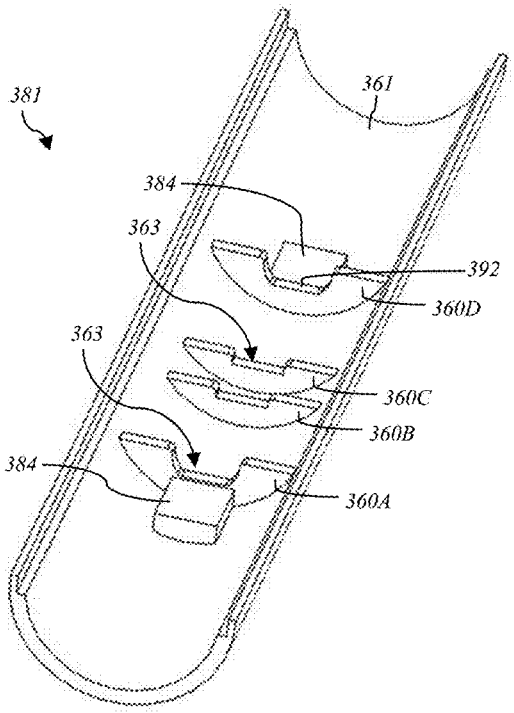
FIG. 10 is a perspective view of a second portion of the cover of FIG. 7 according to an exemplary approach of the disclosure.
Figure 11:
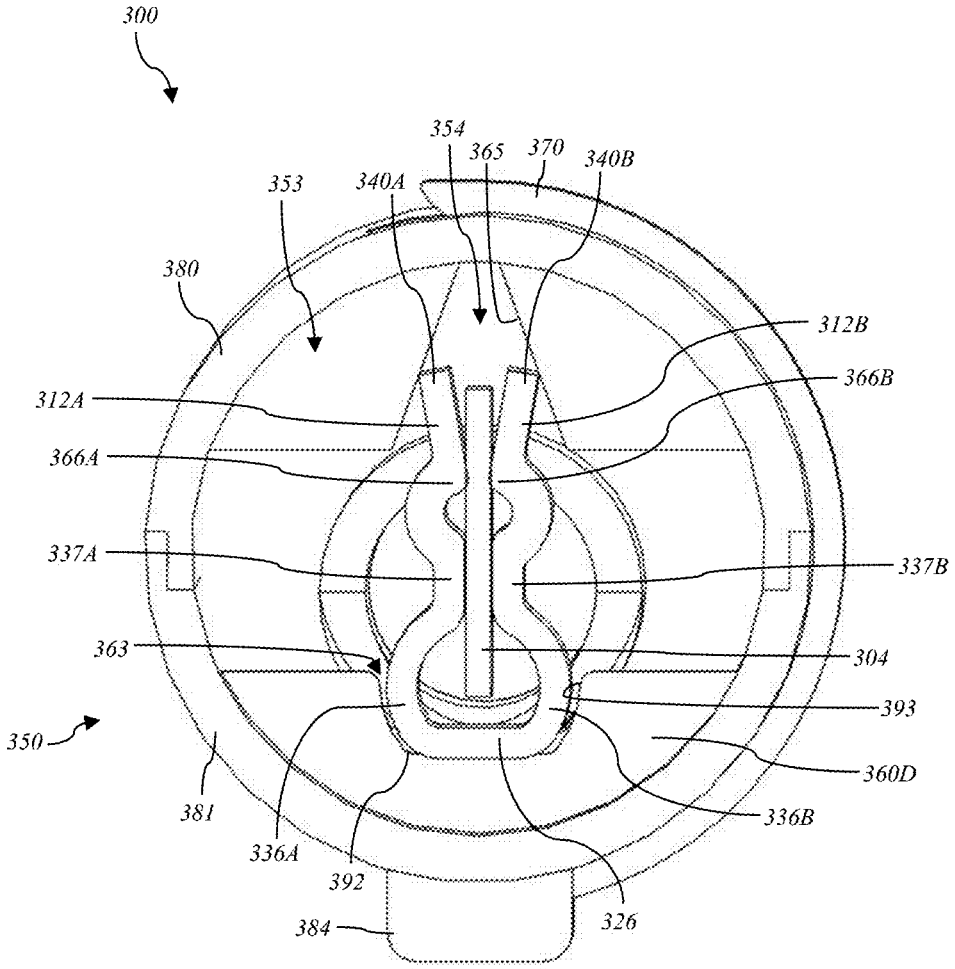

Turning now to FIGS. 9-11, interior portions of the cover 350 according to exemplary embodiments will be described in greater detail. As shown in FIG. 9, the first section 380 includes a first set of protrusions 352 and a second set of protrusions 353, each including a channel 354 provided therebetween. In exemplary embodiments, each of the first and second sets of protrusions 352, 353 extends from an interior surface 355 of the first section 380 towards the second section 381.

As more clearly demonstrated in FIG. 10, the second section 381 includes a plurality of support ribs 360A-D extending from an interior surface 361 thereof. Each of the plurality of support ribs 360A-D may include a central recess 363 to receive the protection device, such as the fuse 102 and terminals 101A-B shown in FIG. 1. In some embodiments, the fastener housing 384 extends from the interior surface 361 towards the first section 380. As shown, the fastener housing 384 is provided adjacent support rib 360A and support rib 360D to provide a platform for each electrically conductive end cap 310.

During use, the cover 350 may be brought from an open position to a closed position, for example as shown in FIG. 11, by securing the first section 380 atop the second section 381. Once in place, an inner sloped surface 365 of the second set of protrusions 353 engage respective free ends 340A-B of the first and second contact elements 312A-B. More specifically, as the free ends 340A-B move further into the channel 354 between the second set of protrusions 353, the inner sloped surfaces 365 cause the first and second contact elements 312A-B to be brought closer together. In exemplary embodiments, inner corners 366A-B and straight sections 337A-B make contact with the fuse blade 304, as shown. Thus, the cover 350 is configured to increase a contact force and electrical connection between the first and second contact elements 312A-B and the fuse blade 304. When both the first and second contact elements 312A-B are engaged and coupled to the fuse blade 304, current can flow through the first and second contact elements 312A-B via the fuse 302.

As further shown, the support rib 360D is configured to receive the first and second contact elements 312A-B within the central recess 363. For example, a recess base 392 may support the first section 326 extending between the first and second contact members 312A-B. An inner sidewall 393 of the central recess 363 surrounds and/or is in abutment with the first bowed sections 336A-B of the first and second contact members 312A-B, respectively. As a result, the support rib 360D may provide a mechanical/physical support or seating area, which increases the contact force and overall stability of the first and second contact elements 312A-B and the fuse blade 304.

Figure 12:
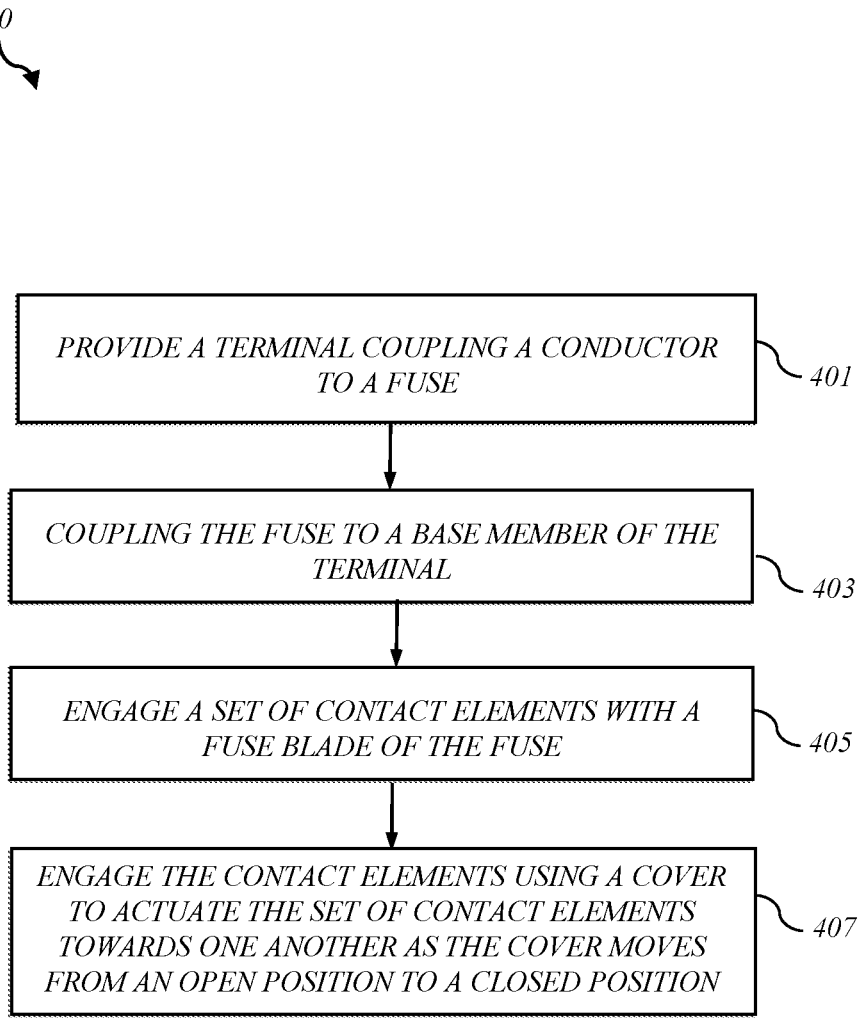
FIG. 12 is a flow chart illustrating an exemplary method according to an exemplary approach of the disclosure.

Turning now to FIG. 12, a method for securing an electrical protection device within an assembly will be described in greater detail. The method 400 includes providing a terminal coupling a conductor to a fuse, as shown at block 401. In some embodiments, the terminal includes an end cap having a cavity for receiving and securing the conductor, and a set of contact elements extending from a base member, wherein the base member coupled to the end cap. The terminal may further include a fuse body of the electrical protection device coupled to the base member, a fuse blade extending from opposite sides of the fuse body.

The method 400 further includes coupling the fuse to the base member, as shown at block 403, wherein a fuse blade of the fuse extends between and engages the set of contact elements, as shown at block 405. In some embodiments, the base includes an opening for engaging the fuse body. In some embodiments, the set of contact elements is bi-furcated or trifurcated to enable as much contact area as possible. In some embodiments, the set of contact elements may include a first contact element and a second contact element, each of the first and second contact elements having at least one bowed section, a straight section coupled to the at least one bowed section, and a free end for engaging a sloped surface of the cover.

The method 400 further includes causing a cover adjacent the terminal to engage the plurality of contact elements as the cover moves from an open position to a closed position, as shown at block 407. In some embodiments, the set of contact elements may be biased together as in interior component of the cover engages a free end of each of the set of contact elements. In one embodiment, the cover may be opened to insert/remove the fuse. In one embodiment, the cover may include a first section matingly engaged with a second section, for example, by a set of overlapping tabs. In one embodiments, the first and second sections are substantially equal halves of a hollow cylinder configured to house the protection device therein. In one embodiment, the cover may be brought from an open position to a closed position, which causes an inner sloped surfaces of the cover to engage respective free ends of the first and second contact elements. As the free ends move further into a channel of the cover, the inner sloped surfaces cause the first and second contact elements to be brought closer together. In some embodiments, a plurality of support ribs are formed within a lower half of the cover, wherein the plurality of support ribs are configured to receive the first and second contact elements therein to provide a seating area for the first and second contact elements.

The method 400 may further include securing the set of contact elements together using a fastener around the cover. In some embodiments, the fastener is a releasable fastener (e.g., a latch, clasp, hook tab and openings, etc.) used to effectively "lock" the terminal into a closed position around the fuse. In some embodiments, each fastener is a latch element pivotably coupled at a first end to a pin, which is secured between walls of a fastener housing extending from an exterior surface of the second section. Each fastener may further include a hook tab disposed at a second end thereof for engagement within a recess formed in an exterior surface of the first section of the cover. In some embodiments, each recess may further define a recess hook tab that is matingly engaged with the hook tab of the fastener.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

The invention claimed is:

1. An apparatus for securing an electrical protection device, the apparatus comprising:
- a conductor; and
- a terminal coupling the conductor to the electrical protection device, the terminal including:
  - an end cap having a cavity for receiving and securing the conductor; and
  - a set of contact elements extending from a base member, the base member directly coupled to the end cap, wherein a fuse body of the electrical protection device is coupled to the base member, and wherein the base member comprises:
    - a first section extending between the set of contact elements, wherein the first section is a planar element positioned under a fuse blade of the electrical protection device; and
    - a second section extending from the first section, wherein the second section extends along a same plane as the first section, and wherein the fuse body is directly coupled to the second section.

2. The apparatus of claim 1, further comprising a grommet surrounding the conductor.

3. The apparatus of claim 1, wherein the electrical protection device is a fuse including the fuse blade and the fuse body.

4. The apparatus of claim 3, wherein the fuse blade is disposed between the set of contact elements.

5. The apparatus of claim 4, the base member including an opening for engaging the fuse body.

6. The apparatus of claim 1, further comprising a cover adjacent the terminal, wherein the cover contacts the set of contact elements in a closed configuration.

7. The apparatus of claim 6, the set of contact elements comprising a first contact element and a second contact element, the first and second contact elements disposed on opposite sides of the electrical protection device.

8. The apparatus of claim 7, each of the first and second contact elements comprising:
- at least one bowed section;
- a straight section coupled to the at least one bowed section; and
- a free end for engaging a sloped surface of the cover.

9. The apparatus of claim 7, wherein the cover includes a first section matingly engaged with a second section, and wherein the first and second sections of the cover are secured together by one or more releasable fasteners.

10. A fuse assembly comprising:
- a conductor;
- a plurality of terminals coupling the conductor to a fuse, each of the plurality of terminals including:
  - an end cap having a cavity for receiving and securing the conductor; and
  - a set of contact elements extending from a base member, the base member directly coupled to the end cap, wherein the base member comprises:
    - a first section extending between the set of contact elements, wherein the first section is a planar element positioned under a fuse blade of the fuse; and
    - a second section extending from the first section, wherein the second section extends along a same plane as the first section, and wherein a fuse body of the fuse is directly coupled to the second section; and
- a cover adjacent the plurality of terminals, wherein the cover engages the set of contact elements in a closed configuration.

11. The fuse assembly of claim 10, wherein the fuse blade is disposed between the set of contact elements for each of the plurality of terminals.

12. The fuse assembly of claim 11, the second section of the base member including an opening for engaging the fuse body.

13. The fuse assembly of claim 10, the set of contact elements comprising a first contact element and a second contact element, each of the first and second contact elements having:
- at least one bowed section;
- a straight section coupled to the at least one bowed section; and
- a free end for engaging a sloped surface of the cover.

14. The fuse assembly of claim 10, wherein the cover includes a first section matingly engaged with a second section, and wherein the first and second sections of the cover are secured together by one or more releasable fasteners.

15. A method of securing a fuse element, the method comprising:

providing a terminal coupling a conductor to a fuse, the terminal including:

an end cap having a cavity for receiving and securing the conductor; and a set of contact elements extending from a base member, the base member directly coupled to the end cap, and the base member coupled to a fuse body of the fuse, wherein the base member comprises:

a first section extending between the set of contact elements, wherein the first section is a planar element positioned under a fuse blade of the fuse; and a second section extending from the first section, wherein the second section extends along a same plane as the first section, and wherein a fuse body of the fuse is directly coupled to the second section; and providing a cover adjacent the terminal, wherein the cover engages the set of contact elements in a closed configuration.

16. The method of claim 15, further comprising crimping the end cap to the conductor.

17. The method of claim 15, further comprising securing the fuse body to a top surface of the base member, wherein a fuse blade of the fuse extends between the set of contact elements.

18. The method of claim 15, further comprising securing a first section of the cover to a second section of the cover using one or more releasable fasteners.

19. The method of claim 15, engaging a free end of each of the set of contact elements with an inner sloped surface of a protrusion extending from an interior surface of the cover to bias the set of contact elements together.

* * * * *